United States Patent [19]

Smirlock et al.

[11] 4,228,747

[45] Oct. 21, 1980

[54] HIGH ENERGY ARC IGNITION OF PULVERIZED COAL

[75] Inventors: Martin E. Smirlock, Brimfield, Mass.; Donald A. Smith, Haddam, Conn.

[73] Assignee: Combustion Engineering, Inc., Windsor, Conn.

[21] Appl. No.: 13,836

[22] Filed: Feb. 22, 1979

[51] Int. Cl.[3] ..... F23D 1/00

[52] U.S. Cl. ..... 110/347; 110/263; 431/2; 431/264

[58] Field of Search ..... 110/347, 263, 264, 265; 431/2, 6, 9, 263, 264, 265, 266

[56] References Cited

U.S. PATENT DOCUMENTS

| | | | |
|---|---|---|---|
| 3,007,084 | 10/1961 | Thomasian et al. | 431/266 |
| 4,019,851 | 4/1977 | Smith et al. | 431/264 X |
| 4,089,628 | 5/1978 | Blackburn | 110/347 X |
| 4,147,116 | 4/1979 | Graybill | 110/347 X |

*Primary Examiner*—Edward G. Favors

*Attorney, Agent, or Firm*—Fishman and Van Kirk

[57] ABSTRACT

An electrical discharge is controlled in such a manner as to permit its use to reliably ignite a fuel stream consisting of pulverized coal entrained in air. The ignition technique of the present invention creates expanding and contracting plasma pockets at a rate which is high compared to the velocity of the fuel stream and permits the ignition of the fuel stream in a cold furnace and/or without supplemental combustion of liquid or gaseous hydrocarbon fuels.

10 Claims, 2 Drawing Figures

HIGH ENERGY ARC IGNITION OF PULVERIZED COAL

BACKGROUND OF THE INVENTION

1. Field of the Invention

The present invention relates to the "direct" ignition of pulverized coal and particularly to the employment of an electric arc to initiate the combustion of a fuel stream comprised of pulverized coal entrained in primary air. More specifically, this invention is directed to the electrically produced ignition of a dense phase coal-air fuel stream with reliability and repeatability and without the use of any supplemental sources of ignition energy. Accordingly, general objects of the present invention are to provide novel and improved methods of such character.

2. Description of the Prior Art

Because of fuel cost and availability problems, it is becoming increasingly desirable to utilize coal rather than natural gas or oil in electricity generating facilities. Present day coal-fired steam generator boilers of the types employed by electrical utilities require, in order to insure safe and efficient operation, the use of premium liquid and gaseous hydrocarbon fuels to provide both ignition and low-load flame-stabilizing energy. By way of example only, it is not uncommon to consume 70,000 gallons of oil for one start-up of a 500 megawatt coal-fired generator unit. Obviously, the elimination of the need to consume such significant amounts of premium fuel in coal-fired plant is present and becoming increasingly urgent.

When compared to natural gas or oil, coal in ungasified form is a difficult fuel to ignite. In fact, until recently it was believed impossible to reliably directly ignite; i.e., to cause ignition in a cold furnace; a fuel stream comprising pulverized coal entrained in air. At this point in time the mechanism of ignition of pulverized coal is not fully understood. It is believed that ignition of coal particles is a function of their surface properties and/or result of the devolatization of gas from such particles. In any event, the initial ignitionary action is probably dependent upon heating rate and thus it is generally considered desirable to deliver high input energy to cause rapid heating with the subsequent release of a significant amount of volatile-forming molecules. In a furnace which has been preheated through the combustion of gas or oil, sufficient energy will be present to insure the ignition of all of the coal particles and the mechanism by which ignition of the individual particles occurs is of secondary importance. However, without a high energy source defined by an oil or gas fuel, which is in the ignited state when coal delivery is initiated, and the hot walls of the furnace, a coal-air fuel stream could not until recently be reliably ignited. Recent work, as exemplified by the disclosure of co-pending application Ser. No. 865,747 filed on Dec. 29, 1977 and entitled "Direct Ignition of Pulverized Coal", has demonstrated that under proper conditions the "direct"; i.e., without supplemental energy sources; ignition of pulverized coal may be reliably accomplished. The disclosure of such co-pending application Ser. No. 865,747, which is assigned to the assignee of the present invention, is incorporated herein by reference.

It is, of course, necessary that conditions be established in a coal-air fuel stream which, when sufficient ignition energy is delivered thereto, will cause a flame to propagate throughout the fuel mixture. Ignition of a cloud of pulverized coal is not a simultaneous event. A typical pulverized coal particle (−200+300 mesh) will burn out within one second. Thus, if a flame is to be propagated, the particles ignited by an ignition energy source must transfer energy to and ignite some of their neighboring particles. The criterion for successful ignition is the rate of heat generated in a flame pocket, which results from the delivery of energy to the fuel stream from the ignition source, must exceed the rate of heat loss due to endothermic devolatization and due to radiation and convection losses. The problem of insuring flame propagation becomes particularly acute where the ignition energy source, because of its nature, is operated intermittently. If freedom from the use of conventional gas and oil fuels is to be achieved, electrically powered sources of ignition energy are dictated. In the case of the most common type of electric energy source, which is a spark discharge, intermittent operation is virtually mandatory.

Spark ignition of combustible fuels has been the subject of considerable study. While it is known that the total spark energy which is available from an arc ignitor may be sufficient to ignite coal particles in the vicinity of the electrical discharge, the rapid discharge associated with conventional arc ignitors initiates a shock wave. Thus, the operation of a conventional spark rod in a fuel stream comprising coal particles entrained in primary air would appear to be undesirable since the shock wave generated at the time of the spark discharge would tend to push the coal particle away from the ignitor tip thus diminishing the possibilities of achieving ignition and subsequent propagation of flame.

As discussed above, in a "cold" furnace the fuel stream must be ignited as it is injected into the furnace. Thus, the problems of achieving "direct" ignition of a fuel stream comprising pulverized coal are aggravated by the fact that the fuel mixture is moving with a certain velocity. Additionally, there is apt to be turbulence in the fuel stream which, although it promotes flame propagation, also causes convective heat loss. This heat loss through convection, in fact, outweighs any advantages in flame propagation that may be derived because of the turbulence. The difficulties in achieving ignition of a moving fuel stream comprising pulverized coal can not be overcome merely by increasing the energy content of the spark utilized as the ignition energy source since the aforementioned problems associated with the creation of shock waves may be aggravated and the life expectancy of the ignitor is inversely related to spark current.

SUMMARY OF THE INVENTION

The present invention overcomes the above-discussed dificiencies and disadvantages of the prior art by providing for the "direct" ignition of a stream of pulverized coal and air in a "cold" environment through the use of only a high energy electrical arc as an ignition energy source. In accordance with the present invention, a "dense phase" fuel stream is delivered to a burner where it is ignited by means of repetitively establishing an electric arc in the stream. As used herein, the term "dense phase" refers to a fuel stream which has an air-to-coal transport weight ratio below approximately 1.0 prior to discharge into the combustion zone. The electrical discharges create, in the fuel stream, expanding and contracting pockets of plasma. These plasma pockets are established at a rate which is high when compared to the velocity of the fuel stream. Thus, with a fuel stream velocity in the range of 60 to 150 feet per second the repetition rate of the spark discharge is in the range of 8 to 12 per second.

Also in accordance with the present invention, the rate of energy discharge in the spark is controlled as to maximize the transfer of energy from the initially ignited particles to neighboring coal particles. This is accomplished by increasing the duration of the spark, when compared to the prior art, and controlling the rate of electrical energy discharge to reduce the compressive shock wave created during initial spark formation and growth. The foregoing results in reduction of the rate of plasma formation and also reduces the pressure gradient and resulting pressure wave thereby minimizing disruption of the surrounding coal-air mixture.

Also in accordance with the present invention, the duty cycle of the spark discharge is controlled and, in the interest of minimizing turbulence and causing recirculation of the flame pockets produced by the periodic spark discharges into a common region so that the energy content thereof will become additive and the flame will spread throughout the mixture, the flow of "secondary" air into the burner is delayed until the presence of some flame is verified.

BRIEF DESCRIPTION OF THE DRAWING

The present invention may be better understood and its numerous objects and advantages will become apparent to those skilled in the art in reference to the accompanying drawing wherein.

DESCRIPTION OF THE PREFERRED EMBODIMENT

Figure 1:
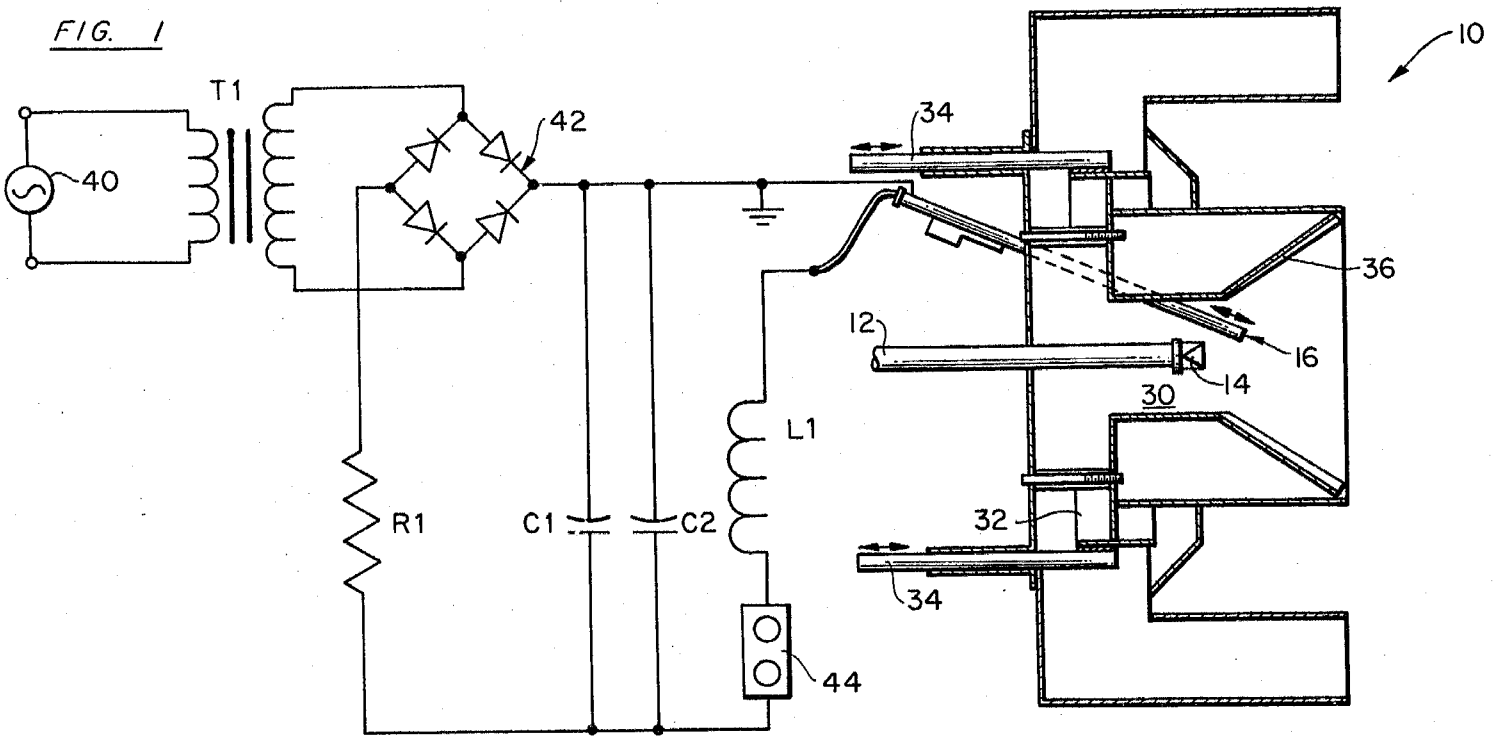
FIG. 1 is a schematic representation of hardware for use in the practice of the method of the present invention.

Exemplary hardware for use in practicing the present invention is depicted in the drawing. With reference to FIG. 1, a burner is schematically indicated generally at 10. It will be understood that a furnace will be fitted with a number of identical burners, functionally identical to burner 10, with the burners being grouped on different elevations. Burner 10 includes a feed pipe 12 through which a fuel stream is delivered to an ignition zone. A "dense phase" fuel stream consisting of pulverized coal entrained in air is caused to flow through pipe 12. As employed herein, the term "dense phase" refers to a coal/air mixture wherein the transport air stream-to-coal weight ratio, measured in pipe 12, is 1.0 or less and preferrably 0.5 or less. A diffuser cone 14 is mounted from the discharge end of the pipe 12 to cause dispersing of the fuel stream for the purpose of creating a low velocity recirculation zone; i.e., an adverse pressure gradient is established downstream of cone 14; whereby pockets of burning coal are directed back toward the ignitor tip and the incoming fuel.

Figure 2:
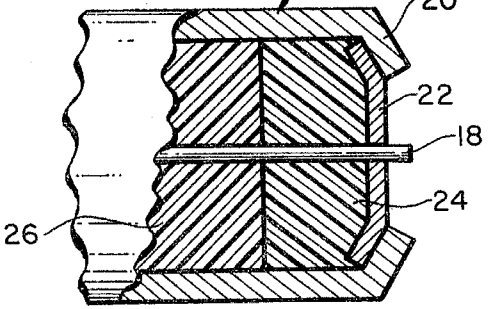
FIG. 2 is a cross-sectional view of a spark ignitor of the type which may be employed in the practice of the present invention.

A high energy spark-ignitor, indicated generally at 16 in FIGS. 1 and 2, is retractably mounted so that the tip thereof may be positioned in burner 10 immediately downstream of the discharge and of feed pipe 12. As may be seen from FIG. 2, ignitor 16 typically includes a rod shaped inner electrode 18 and a cylindrical outer electrode 20. At the tip of the ignitor the inner and outer electrodes are separated by means of a layer of semi-conductor material 22. Further support and electrical isolation between the inner and outer electrodes, adjacent the ignitor tip, is provided by a ceramic disc 24 and the interior of electrode 20, in those areas not taken up by ceramic disc 24 and semi-conductor 22, will be filled with a suitable insulating material, such as an epoxy resin, as indicated at 26.

The burner 10 also includes means for supplying "secondary" air to the ignition zone about the feed pipe 12. The secondary air passage is indicated at 30 and includes a flow control damper. In the burner shown in the drawing the damper is indicated at 32 and, through manipulation of adjustment arms 34, the secondary air flow may be varied between the full flow and the completely off conditions. The secondary air passage 30 includes a plurality of vanes, not shown, which are arranged to impart a swirl to the air which is, of course, delivered to passage 30 from a pressurized air supply, also not showh. The secondary air passage 30 terminates in a divergent nozzle 36.

The burner 10 also includes an annular shaped auxiliary air nozzle 38. Air will be flowing through the auxiliary air nozzle at the time of ignition in accordance with the present invention.

The means for establishing a sufficient potential difference between the electrodes 18 and 20 to cause the air in the vicinity of the ignitor tip to ionize and an arc to be established includes a step-up transformer T1 having its primary winding connected to a suitable source of alternating current such as indicated schematically at 40. A high potential, for example 2500 volts, will typically appear across the secondary winding of transformer T1 and the alternating current induced in the transformer secondary winding will be converted into direct current by means of a bridge type rectifier 42 which is connected across the secondary winding of the transformer. As shown in FIG. 1, a first polarity terminal of rectifier 42 is connected to ground. The outer electrode 20 of ignitor 16 is also connected to ground. The opposite polarity terminal of rectifier 42 is connected to the inner electrode 18 of ignitor 16 by a series circuit comprising resistor R1, a switch device in the form of a spark gap 44 and an inductance L. A capacitance, in the form of a pair of capacitors C1 and C2, is connected in parallel with the series circuit defined by spark gap 44, inductor L1 and the ignitor 16.

In operation, a charge will be stored in capacitors C1 and C2 until the breakdown voltage of spark gap 44 is exceeded whereupon the capacitors will discharge to ground via the ignitor tip; the air in the space between the electrodes 18 and 20 ionizing whereby an arc will be established between electrode 18 and grounded electrode 20. Thus, when capacitors C1 and C2 are charged to a specific voltage, approximately 1800 volts in one reduction to practice, the spark gap 40 breaks down and sends the stored energy through the ignitor 16 in the form of an electric arc. The resistor R1 controls the rate of recharging of capacitors C1 and C2 and thus determines the spark repetition rate of the ignitor. The inductor L1 increases the arc discharge time and results in a "soft" spark at the ignitor tip. If the inductor L1 were not in the circuit, the arc established at the ignitor tip would be a quick, sharp release of energy generating a shock wave which would tend to push the coal particles away from the ignitor tip. However, bearing in mind that the dense phase fuel stream is comparatively hard to ignite, the inductor L1 must be sized such that there will not be excessive dissipation of energy therein at the desired frequency of operation. Inductor L1 will have an inductance in the range of 1μh to 30μh with 15μh being typical.

In accordance with the present invention, in order to reliably ignite a "dense phase" fuel stream comprising coal particles entrained in the primary transport air, the following criteria are observed:

(1) The fuel stream will have a transport air-to-coal weight ratio of less than 1.0 and preferrably less than 0.5.

(2) The velocity of the fuel stream will be less than 150 feet per second and preferrably in the range of 60–75 feet per second.

(3) The rate at which the ignitor is operated is in the range of 8 to 12 sparks per second.

(4) The energy available to be dissipated with each arc-over of the ignitor is in the range of 6 to 12 Joules at the ignitor tip with the peak current typically being in the range of 1500 to 2000 amps. To obtain 10 Joules for dissipation at the ignitor tip, a power supply which is rated at 30 Joules would be employed.

(5) The duration of each arc at the ignitor tip, as measured by the arc current falling to zero and remaining at the zero level for more than 5μsec, is in the range of 100 to 200μsec with 150 microseconds being a preferred duration. In one reduction to practice, the arc was on for 150 microseconds and off for 1/10 of a second.

(6) The flow of secondary air will be delayed until ignition of some coal particles by the arc ignitor has been verified.

While a preferred embodiment has been shown and described, various modifications and substitutions may be made thereto without departing from the spirit and scope of the invention. Accordingly, it will be understood that the present invention has been described by way of illustration and not limitation.

What is claimed is:

1. A method for igniting a fuel stream comprising pulverized coal in the absence of any sources of ignition energy other than an electric arc ignitor disposed in the stream, said method comprising the steps of:

establishing a fuel stream having a transport air-to-coal weight ratio of less than unity and having a velocity not exceeding 150 feet per second;

directing the fuel stream to an ignition zone, an electric arc ignitor projecting into the ignition zone; and creating an intermittent electric arc in the fuel stream at the ignitor tip, said arc being established at a frequency in the range of 8 to 12 times per second, each arc lasting for between 100 and 200 microseconds and resulting in the dissipation of between 6 and 12 Joules of energy at the ignitor tip.

2. The method of claim 1 further comprising:

establishing a flow of secondary air in the ignition zone subsequent to creation of the intermittent arc to cause recirculation of ignited coal particles toward the ignitor.

3. The method of claim 1 wherein the step of directing the fuel stream into the ignition zone includes:

creating a low velocity recirculation region in the ignition zone to cause ignited coal particles to be recirculated toward the ignitor and incoming fuel stream.

4. The method of claim 3 further comprising:

establishing a turbulent flow of secondary air about the periphery of the ignition zone subsequent to the ignition of coal particles to enhance the recirculation of burning particles into the recirculation region.

5. The method of claim 3 wherein the step of creating a low velocity recirculation region comprises:

causing the fuel stream to diverge in the form of a hollow cone upstream of the ignitor.

6. The method of claim 4 wherein the step of creating a low velocity recirculation region comprises:

causing the fuel stream to diverge in the form of a hollow cone upstream of the ignitor.

7. The method of claim 1 wherein the step of establishment of the fuel stream comprises:

forming a mixture of primary transport air and pulverized coal having an air-to-coal weight ratio of less than 0.5 and a velocity in the range of 60 to 75 feet per second.

8. The method of claim 6 wherein the step of establishment of the fuel stream comprises:

forming a mixture of primary transport air and pulverized coal having an air-to-coal weight ratio of less than 0.5 and a velocity in the range of 60 to 75 feet per second.

9. The method of claim 1 wherein the step of creating an intermittent arc comprises:

charging a capacitance;

discharging the capacitance through an inductance and the ignitor when the capacitance has been charged to a predetermined level, air in the vicinity of the ignitor tip ionizing to permit the establishment of an arc whereby the capacitance may discharge; and recharging the capacitance after the arc current has remained at the zero amphere level for a finite period.

10. The method of claim 8 wherein the step of creating an intermittent arc comprises:

charging a capacitance;

discharging the capacitance through an inductance and the ignitor when the capacitance has been charged to a predetermined level, air in the vicinity of the ignitor tip ionizing to permit the establishment of an arc whereby the capacitance may discharge; and recharging the capacitance after the arc current has remained at the zero amphere level for a finite period.

* * * * *